US006000440A

United States Patent [19]

Hay

[11] Patent Number: 6,000,440

[45] Date of Patent: Dec. 14, 1999

[54] MULTI-LAYER PAPERMAKING FABRIC

[75] Inventor: Stewart Hay, Lancashire, United Kingdom

[73] Assignee: Scapa Group PLC, Blackburn, United Kingdom

[21] Appl. No.: 09/051,197

[22] PCT Filed: Oct. 4, 1996

[86] PCT No.: PCT/GB96/02419

§ 371 Date: Apr. 3, 1998

§ 102(e) Date: Apr. 3, 1998

[87] PCT Pub. No.: WO97/13029

PCT Pub. Date: Apr. 10, 1997

[30] Foreign Application Priority Data

Oct. 5, 1995 [GB] United Kingdom ..... 9520516

[51] Int. Cl.[6] ..... D21F 1/00

[52] U.S. Cl. ..... 139/383 A

[58] Field of Search ..... 139/383 A

[56] References Cited

U.S. PATENT DOCUMENTS

| | | | |
|---|---|---|---|
| 3,858,623 | 1/1975 | Lefkowitz | 139/383 A |
| 4,518,644 | 5/1985 | Vuorio . | |
| 4,739,803 | 4/1988 | Borel . | |
| 5,025,839 | 6/1991 | Wright | 139/383 A |

FOREIGN PATENT DOCUMENTS

| | | |
|---|---|---|
| 0 085 363 | 8/1983 | European Pat. Off. . |
| 2 245 006 | 12/1991 | United Kingdom . |

*Primary Examiner*—Andy Falik

*Attorney, Agent, or Firm*—Jacobson, Price, Holman & Stern, PLLC

[57] ABSTRACT

A multi-layer fabric with paperside to lower surface weft ratios of greater than 1 in which all paperside weft yarns interlace with the warp yarns in an identical manner. The paperside weft yarns intermittently buttress against adjacent paperside weft yarns and possess an average lateral crimp ratio of greater than 1.62 giving a fabric having an air permeability of less than 275 c.f.m. at ½ inch water pressure.

10 Claims, 2 Drawing Sheets

MULTI-LAYER PAPERMAKING FABRIC

BACKGROUND OF THE INVENTION

1. Field of the Invention

The invention is concerned with fabrics, which are particularly, but not exclusively, for use as papermachine clothing and ideally for use in the forming section of the papermachine.

2. Description of the Related Art

The original synthetic forming fabrics utilised one warp system and one weft systems. However these, so called, single-layer fabrics tended to narrow and stretch thus interfering with paper production and machine performance. So called mlti-layer fabrics were therefore developed to overcome the dimensional instability of the single-layer fabrics. Of these, the so called two-layer fabrics have become the most common type of forming fabric. Two-layer fabrics utilise one warp system which interlaces with two distinct weft systems. The warp system provides a greater amount of warp material, for stability, than the prior single-layer fabrics.

Two-layer weaves, in addition to improving fabric stability, also allow further benefits over single-layer fabrics. These benefits are due to the two separate weft systems.

The wearside weft system protects the load-bearing warp yarns by providing long "floats" which contact the dewatering elements on the papermachine. Furthermore as the wearside weft never appears on the paperside then relatively thick yarns can be used to provide a significant amount of material for wear. By this means improved fabric lives can be obtained without causing undesirable wiremark.

The paperside weft system interlaces with the warp to provide a surface for the formation, dewatering and release of the papersheet. Relatively thin weft yarns may be used to minimise wiremark, as these yarns do not appear on the wearside. Improved papermaking properties are thus obtained.

Single-layer fabrics were subsequently made using weave patterns which also offered inproved dimensional stability. For example U.S. Pat. No. 4,518,644 teaches that relatively stable single-layer fabrics can be obtained by causing "the longitudinal and/or transverse threads to change the direction of their course intermittently in the plane of the fabric". The resulting lateral crimp added a pronounced "diagonal" aspect to the usual three yarn orientations of: machine direction, cross-machine direction, and vertical crimp. The lateral crimp was of sufficient magnitude that adjacent yarns made intermittent contact such that a buttressing effect was achieved.

Improvements in single-layer stability were possible by this means. However as such structures still possess only single weft and warp systems it is not possible to obtain both the papermaking and wear resistance improvements which are provided with the two-layer structures.

Furthermore, U.S. Pat. No. 4,518,644 had the declared objective of obtaining a single-layer fabric with maximum thickness, maximum inner volume and a minimum open area (in vertical sight). It is now known that the foyer two properties can contribute to water carrying within the fabric body.

Fabric water carry is particularly undesirable on Gap Former machines. Such machines operate at relatively high speed and possess comparatively short dewatering sections with which to remove water from the sheet. Consequently such machines tend to produce sheets with an undesirably high moisture content. This problem is worsened by moisture carried within the voids of the fabric rewetting the sheet. Bearing this in mind an ideal structure for use on modern papermachines will possess relatively low thickness and void volume.

The single-layer structure described in U.S. Pat. No. 4,518,644 also maintained a high permeability indicating the relative openness of the structure and the limitation of the structure with regards to retention of fines and filler.

Latterly a need for paper with, for example, improved printing characteristics developed. It was realized that such paper could be produced by using two-layer fabrics with an increased paperside: wearside weft ratio of 2:1. Thus EP 0085363 allowed for the inclusion of an additional set of "floater" weft yarns on the cloth paperside to improve retention and papermaking characteristics.

The set of floater weft yarns described in EP 0085363 are of "substantially" smaller diameter than the set of parallel integral paperside weft yarns with which the floater yarns alternate. Preferably the diameter of the floater yarns is 50–75% that of the interwoven parallel yarns.

The floater wefts make no interlacing with the warp in contrast to the integral weft yarns which do interlace with the warp. As a consequence of the difference in crimp patterns and weft diameters between the two sets of paperside weft yarns it is not possible for the two sets of wefts to achieve an approximately level height on the paperside when material possessing identical properties is used for both sets of weft.

An ideal fabric will provide a good papermaking surface by means of numerous regularly distributed support points. To offer useful primary support to the fibre mat or papersheet these support points must be of similar height. Consequently the structures described in EP 0085363 must necessarily utilize material of significantly different thermal shrinkage to allow the two sets of paperside weft yarns to sit at approximately the same height on the paperside surface of the fabric.

A further drawback with the structures formed according to EP 0085363 is their relative instability. Such structures are relatively unstable because the thin "floater" wefts, which in two-layer structures typically represent one-third of all of the weft yarns present, make no interlacings with the warp yarns.

Consequently such structures contain a comparatively low number of yarn interlacings thus allowing adjacent warp yarns to shift position with relative ease. This type of shearing movement is indicative of fabric structures which may narrow significantly on a misaligned or irregularly worn papermachine.

Fabric narrowing will result in warp density variation which in turn may cause uneven drainage across the width of the fabric. Such fabric may also be prone to rippling in the machine direction. This effect is particularly problematic on Gap Former type machines which utilise an enclosed forming zone and are prone to "streaky" sheet formation in the machine direction. An ideal forming fabric will, therefore, possess a structure with a high resistance to shear distortion.

U.S. Pat. No. 4,739,803 discloses a two-layer fabric with a weft ratio of 2:1 wherein all of the weft yarns are interlaced with warp yarns. Thus shear resistance may be enhanced. However, as with the prior type of 2:1 fabric with floater wefts, there are still alternating sets of wefts on the paperside of this fabric. The first set of wefts are supported in a crimp "saddle" whereas the second set of wefts are supported in a shear like manner between warp yarns. Thus two sets of support points are created at the fabric paperside. The resulting sets of support points tend to sit at different heights.

To compensate for the difference in height of paperside support points of cloth according to U.S. Pat. No. 4,739,803, and thus optimise sheet support for the structure, it is necessary for the two sets of paperside weft yarns to be of different diameter and/or for the two sets of paperside weft yarns to be of different material and/or thermal shrinkage. Raw material and production processes must thus be strictly controlled to obtain the desired fabric.

As has been stated to minimise sheet rewetting it is desirable to avoid both relatively high void volume and high fabric thickness. However both of the prior art two-layer designs so far described maintain relatively high void volume and thickness.

Although the structure described in U.S. Pat. No. 4,739,803 develops a degree of lateral crimp in at least some o the paperside weft yarns no weft buttressing is described therein.

Additionally both prior art structures maintain a high permeability.

The air permeability of a fabric can indicate the openness of the paperside surface. A highly open fabric surface can promote excessive fibre penetration resulting in sheet sealing of the fabric drainage channels. An undesirably rough paper surface may therefore occur.

Furthermore the subsequent dewatering efficiency of the structure can be reduced by this effect.

It is also understood that fabric with high air permeability may allow similarly high initial dewatering of the fibre stock. The fast initial dewatering can cause low retention due to the fines present in the stock being washed out. Additionally a compact layer of fibre at the fabric surface may be created through which it becomes difficult to remove the remaining water.

By reducing the openness of the fabric's paperside surface, as may be indicated by a lower fabric permeability, it is possible to reduce the rapid rate of initial drainage. The controlled initial sheet dewatering allows a more effective use of all the dewatering elements positioned throughout the forming section such that water is removed more evenly.

The delayed dewatering facilitates the "working" of the fibres by dewatering elements such that good sheet formation can be achieved. This type of phenomena was certainly observed when the very high pemeability single-layer fabrics were superceded by the current double-layer structures.

However even the prior art double-layer structures may be considered to possess an unnecessarily high permeability.

A two-layer, 8-shaft weave repeat structure, with a weft ratio of 2:1 wherein all paperside weft yarns interlace in the same manner with the warp yarns is described in GB 2245006A.

The object of the invention described therein is to obtain a stable structure. This is sought by employing a short weave repeat such that the warp yarns must "rise and descend at a sharper angle when passing between the upper and lower surfaces of the fabrics". Thus GB 2245006A is unlike the current invention which utilises the buttressing action of adjacent weft yarns to obtain excellent shear resistance.

As with all other prior art structures a high permeability fabric is obtained. In fact permeability is stated as being "extremely high as compared with prior art solutions".

It is intimated that for good papermaking properties the density of weft yarns in the paperside of the fabric is set to achieve an air permeability of at least 500 c.f.m. In this respect also the fabric described in GB 2245006A is drastically different from that invented by the applicants.

The concept of a high permeability structure with a relatively open surface is diametrically opposed to that pertaining to the invention.

BRIEF SUMMARY OF THE INVENTION

It has been found by the applicants that intermittent buttressing of adjacent, warp bound, paperside weft yarns is desirable to optinmise fabric stability; to reduce fabric openness (as indicated by low air permeability) for a reduced rate of dewatering with all the attendant benefits in sheet smoothness and less two sidedness: to provide additional yarn area for sheet support; and to reduce void volume for minimal sheet rewetting.

The term buttressing is used to define the close proximity of adjacent weft yarns. Intermittent buttressing refers to the fact that weft yarns only buttress at "buttress points" that is: the regions of the weave where the forces in play at the warp-weft interlacing act to pull adjacent weft yarns into contact.

In the invention the intermittent weft buttressing will normally occur at each buttress point in the weave where two adjacent weft yarns are bound by a single warp binding. Buttress points are more fully described hereinafter with specific reference to FIG. 1 which illustrates the paperside of a preferred rendering of the invention.

Intermittent buttressing does not describe the situation where a number of the adjacent weft yarns have not buttressed at any point along their length.

In certain renderings of the invention, due to production variables, the fabric may contain areas where a certain number of adjacent paperside weft yarns do not buttress at any point along their length or where buttressing does not occur at every potential buttress point.

The present invention therefore seeks to provide a multi-layer fabric with a ratio of paperside weft yarns to underlayer weft yarns being in excess of 1:1 (or 1:1:1 etc), wherein all paperside weft yarns are of uniform warp interlacing pattern and wherein all paperside weft yarns exhibit a degree of lateral crimp such that adjacent paperside weft yarns make intermittent contact and buttress against each other thereby producing a structure with high shear resistance.

It is another object of the invention to produce a structure with a relatively closed paper surface, as evidenced by low permeability readings, to delay initial dewatering sufficiently to enhance retention of fines and fillers in the sheet thus reducing two sidedness which can occur when the fines on the fabric side of the sheet are washed through the fabric.

It is a further object of the invention to produce a structure with relatively low fabric thickness and void volue to minimise water carry and so reduce sheet rewetting characteristics.

It is yet another object of the invention to provide a structure with a good papermaking surface, wherein all paperside weft yarns are bound in the same manner such that each of said paperside weft yarns provides sheet support points of substantially equal height.

According to a first aspect of the present invention there is provided a multi-layer fabric with paperside to lower surface weft ratios of greater than 1, wherein all paperside weft yarns interlace with the warp yarns in an identical manner and wherein said paperside weft yarns intermittently buttress against adjacent paperside weft yarns and possess an average lateral crimp ratio of, or greater than, 1.62 giving a fabric characterised by an air permeability of less than 275 c.f.m. at ½ inch water pressure.

According to a second aspect of the present invention there is provided a multi-layer fabric with paperside to lower surface weft ratios of greater than 1, wherein all paperside weft yarns interlace with the warp yarns in identical manner and wherein at least half of the total number of said paperside weft yarns interittently buttress against adjacent paperside weft yarns and possess an average lateral crimp ratio of, or greater than, 1.62 giving a fabric characterised by an air permeability of less than 275 c.f.m. at ½ inch water pressure.

According to a third aspect of the present invention there is provided a multi-layer fabric with paperside to lower surface weft ratios of greater than 1, wherein all paperside weft yarns interlace with the warp yarns in identical manner and wherein said paperside weft yarns possess an average lateral crimp ratio of, or greater than, 1.62 and wherein the extremities of the lateral crimp of adjacent paperside weft yarns lie within a distance equivalent to one quarter of the nominal diameter of the paperside weft yarn giving a fabric characterised by an air permeability of less than 275 c.f.m. at ½ inch water pressure.

According to a fourth aspect of the present invention there is provided a multi-layer fabric with paperside to lower surface weft ratios of greater than 1, wherein all paperside weft yarns interlace with the warp yarns in identical manner and wherein all adjacent paperside weft yarns intermittently buttress at at least half of the available buttress points and possess an average lateral crimp ratio of, or greater than, 1.62 giving a fabric characterised by an air permeability of less than 275 c.f.m. at ½ inch water pressure.

Preferably all of the paperside weft yarns are intermittently buttressed. However, the looms, weave patterns and materials used to make these fabrics may be combined in such a way that there is production of fabrics wherein not every pair of adjacent weft yarns are intermittently buttressed or wherein adjacent weft yarns do not buttress at each potential buttress point.

In a preferred emodiment of the invention all paperside weft yarns are of substantially equal diameter.

Preferably all paperside weft yarns are produced from substantially similar polymeric material.

All paperside weft yarns preferably possess substantially similar thermal shrinkage.

In a preferred enodiment of the invention all warp and weft yarns are polymeric monofilaments.

To enhance certain properties of the invention, without causing an unacceptable deterioration in other properties, a proportion of the paperside weft yarns may utilise a material with, for example, superior contamination resistance.

Preferably adjacent, or otherwise interspersed, paperrside weft yarns are produced from dissimilar polymeric material.

It is now appreciated by those skilled in the art that the fabric-fibre interface can influence fabric dewatering. The invention provides a good papermaking surface to allow sheet formation to occur high up on the fabric surface thus maintaining the fabric voids to facilitate the passage of water. Consequently it is possible to utilise a fabric of the invention with its inherently high shear resistance but yet still obtain the requied sheet dewatering even with the relatively low void volume of the invention.

BRIEF DESCRIPTION OF THE DRAWINGS

In order that the present invention may be more readily understood a specific embodiment of the invention will now be described with reference to the accompanying drawings in which.

DETAILED DESCRIPTION OF THE INVENTION

Figure 1:
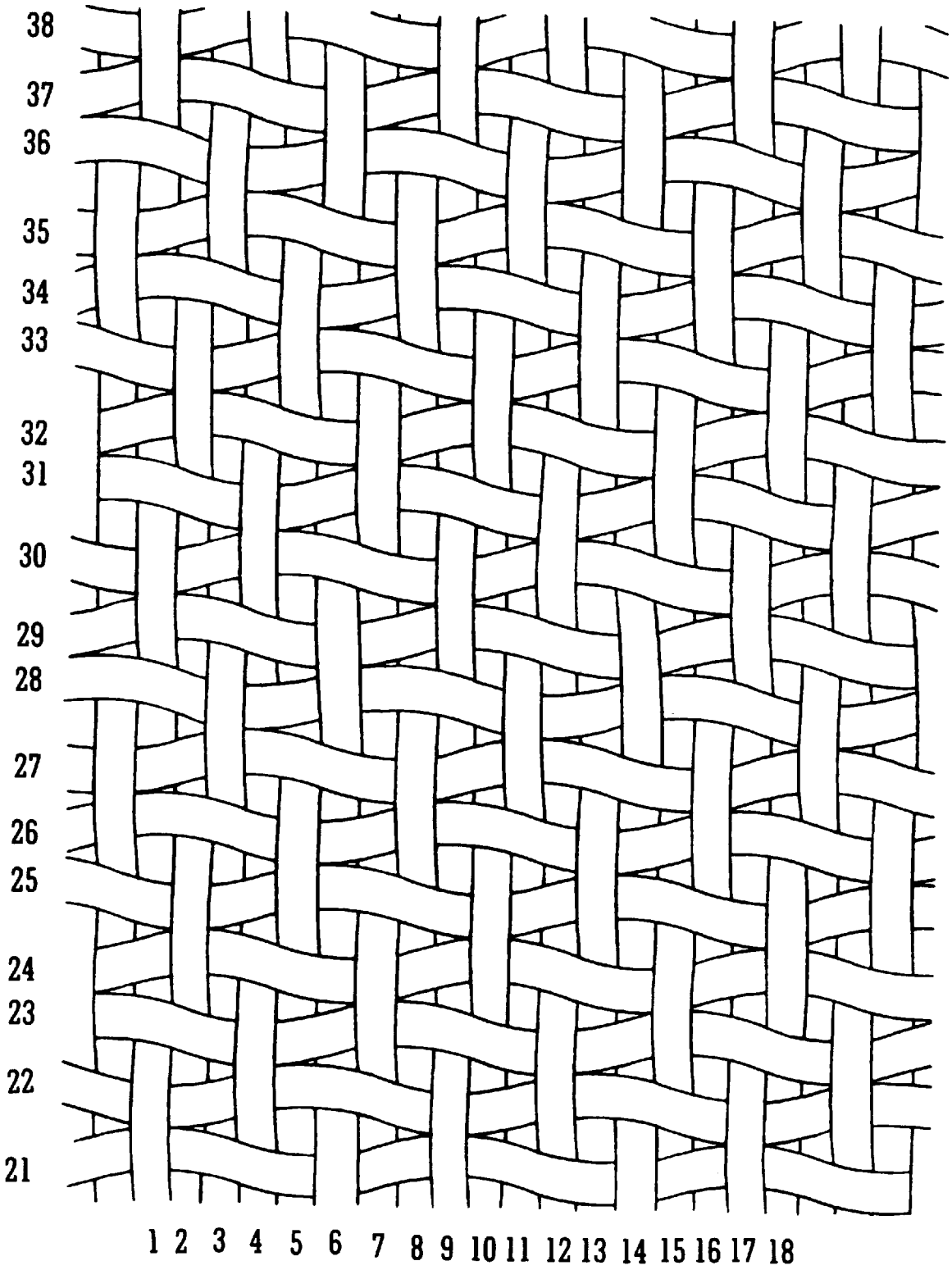
FIG. 1 shows the paperside weave pattern of one fabric in accordance with the invention.
Figure 2:
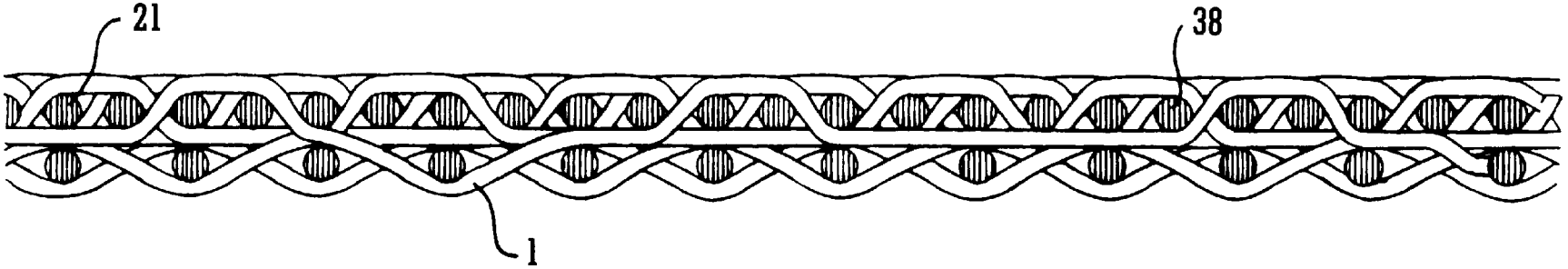
FIG. 2 shows the warp path of the fabric of FIG. 1.

Referring to the drawings weft yarn 21 is bound by warp yarns 1;6;9 and 14. Similarly weft yarn 22 is bound by warp yarns 1;4;9 and 12. Consequently wefts 21 and 22 will be pulled into a buttressing arrangement at, and because, of, their binding by ends 1 and 9. The region formed by warp yarn 1 and weft yarns 21 and 22 can be referred to as a buttressing point. The next buttressing point for weft yarns 21 and 22 is at warp yarn 9. Conversely wefts 21 and 22 will be pulled apart to generate lateral crimp and to create buttress points against wefts 36 and 23 respectvely by the respective binding actions of warps 6 and 14 (for weft 21) and by warps 4 and 12 (for weft 22). Consequently intermittent buttressing is achieved by the weft yarns of the paperside of the invention.

Table 1 provides corresponding data and measured values for a two-layer rendering of the invention and for a prior art two-layer design of similar mesh and yarn values made in accordance with EP 0085363. The weave of both fabrics repeats on 16 warp yarns in this instance. It will, of course, be understood that the fabric of the invention is not limited to 16 shaft repeat but that this is used for illustrative reasons only.

Both of the structures described in Table 1 utilise paperside:wearside weft ratio of 2:1. Alternating polyester and polyamide monofilament weft yarns were utilised in the wearside of both structures whereas all warp yarns and paperside weft yarns were polyester monofilament.

The lateral crimp of the paperside weft yarns for both of the structures detailed at Table 1 was measured over a full weave repeat and the average lateral crimp was calculated. A lateral crimp ratio equal to the average measured lateral crimp (mm)/nominal yarn diameter (mm) is used to remove the effect of diameter from the lateral crimp value. The value thus obtained is expressed as the "Lateral Crimp (LC) Ratio".

From Table 1 the LC ratio of the invention is approximately 20% higher than that of the prior art design (1.96× 1.62). Buttressing of the paperside weft also occurred in the invention. Numerous fabrics of the invention have been produced—all possessed LC ratio in excess of 1.62. Similarly all possessed buttressing of the paperside weft yarns.

The shear resistance of the fabric was measured by means described by W. Kufferath (Das Papier, Vol 33, No. 6, p 258) viz: a fabric strip is attached at one end to a fixed clamp and is displaced transversely in its plane by a second clamp. The displacement is measured in mm and is normally expressed as a percentage of the sample length. The greater the value then the lower the resistance of the fabric to distortion and narrowing on the papermachine.

In Table 1 the shear resistance of the prior art fabric has been allocated the value of 100. The shear resistance of the invention has the relative value of 24. Thus the invention has approximately four times greater resistance to shear distortion than the prior art structure.

In addition to contributing to the shear resistance of the invention the high LC ratio indicates an intermittent diagonal orientation of the paperside weft yarns such that a significant additional area of weft material is provided for sheet support.

Furthermore the rendering of the invention detailed at Table 1 provides approximately 38% more sheet support points than the prior art fabric. This is primarily due to the presence of two times the number of warp/weft interlacings in the paperside surface of the invention when compared with the paperside surface of the prior art structure containing identical wefts/cm.

The thickness and void volume values displayed by the invention in Table 1 are significantly lower than those of the prior art structure also displayed therein (at approximately 14 and 24% respectively).

The fabric of the invention as detailed in Table 1 is less than half as permeable as the prior art fabric as measured on Fasier Air Permeomter at 0.5 inch pressure differential.

TABLE 1

| | Prior Art | Invention |
|---|---|---|
| Warps/cm | 36.6 | 36.3 |
| Wefts/cm | | |
| Total | 32.1 | 33.6 |
| Paperside | 21.4 | 22.4 |
| Wearside | 10.7 | 11.2 |
| Weft Ratio (P:W) | 2:1 | 2:1 |
| Warp Dia. (mm) | 0.30 | 0.30 |
| Weft Dia. (mm) | | |
| Paperside | 0.30/0.20 | 0.25/0.25 |
| Wearside | 0.40/0.40 | 0.40/0.40 |
| Ave. Lateral Crimp Ratio | 1.62 | 1.96 |
| Shear Resistance | 100 | 24 |
| Support Points (/cm2) | 147 | 203 |
| Interlacings/warp/repeat | (4/48) 0.083 | (4/24) 0.167 |
| Thickness (mm) | 1.39 | 1.19 |
| Void Volume (cm3/m2) | 850 | 647 |
| Permeability (cfm) | 480 | 225 |

A second rendering of the invention is compared with a prior art structure of similar mesh and yarn values at Table 2. As with Table 1 the weave of both structures repeat on 16 warp yarns.

Regarding the lateral crimp ratio of the fabrics detailed at Table 2, the invention has a ratio approximately 17% greater (1.76 v. 1.50) than the prior art structure (Table 1 invention was approximately 20% greater).

Regarding the shear resistance of the fabrics detailed at Table 2, the invention has approximately two times the shear resistance of the equivalent prior art fabric (Table 1 invention had approximately four times the shear resistance of the equivalent prior art structure).

Regarding the sheet support points on the fabrics detailed at Table 2, the invention offers approximately 35% more than the equivalent prior art weave primarily because of the increased warp/weft interlacings. (Table 1 invention offered approximtely 38% increase compared to prior art).

Regarding thickness and void volume for the two fabrics detailed at Table 2, the invention provided reductions of approximately 15% and 28% respectively. (Table 1 invention was approximately −14% and −24% respectively).

Regarding the permeability of the two fabrics detailed in Table 2, the invention gave a reduction in air porosity of approximately 61% by comparison to the prior art design. (Table 1 rendering was approximately 53% less porous than the equivalent prior art design).

TABLE 2

| | Prior Art | Invention |
|---|---|---|
| Warps/cm | 46.1 | 44.9 |
| Wefts/cm | | |
| Total | 45.3 | 47.1 |
| Paperside | 30.2 | 31.4 |
| Wearside | 15.1 | 15.7 |
| Weft Ratio (P:W) | 2:1 | 2:1 |
| Warp Dia. (mm) | 0.22 | 0.22 |
| Weft Dia. (mm) | | |
| Paperside | 0.25/0.17 | 0.22/0.22 |
| Wearside | 0.35/0.35 | 0.35/0.35 |
| Ave. Lateral Crimp Ratio | 1.50 | 1.76 |
| Shear Resistance | 100 | 48 |
| Support Points (/cm2) | 261 | 352 |
| Interlacings/warp/repeat | (4/48) 0.083 | (4/24) 0.167 |
| Thickness (mm) | 1.18 | 1.00 |
| Void Volume (cm3/m2) | 738 | 533 |
| Permeability (cfm) | 395 | 155 |

It is to be understood that the above described embodiment of the invention has been described by way of illustration only. Many modifications and variations are possible.

I claim:

1. A multi-layer fabric with paperside to lower surface weft ratios of greater than 1, wherein all paperside weft yarns interlace with the warp yarns in an identical manner and wherein said paperside weft yarns intermittently buttress against adjacent paperside weft yarns and possess an average lateral crimp ratio of, or greater than, 1.62 giving a fabric characterised by an air permeability of less than 275 c.f.m. at ½ inch water pressure.

2. A multi-layer fabric as claimed in claim 1, wherein all of the paperside weft yarns are intermittently buttressed.

3. A multi-layer fabric as claimed in claim 1, wherein not every pair of adjacent weft yarns are intermittently buttressed.

4. A multi-layer fabric as claimed in claim 1, wherein not every pair of adjacent weft yarns are buttressed.

5. A multi-layer fabric as claimed in claim 1, wherein adjacent weft yarns do not buttress at each potential buttress point.

6. A multi-layer fabric as claimed in claim 1 wherein all paperside weft yarns are of substantially equal diameter.

7. A multi-layer fabric as claimed in claim 1, wherein all warp and weft yarns are polymeric monofilaments.

8. A multi-layer fabric with paperside to lower surface weft ratios of greater than 1, wherein all paperside weft yarns interlace with the warp yarns in an identical manner and wherein at least half of the total number of said paperside weft yarns intermittently buttress against adjacent paperside weft yarns and possess an average lateral crimp ratio of, or greater than, 1.62 giving a fabric characterised by an air permeability of less than 275 c.f.m. at ½ inch water pressure.

9. A multi-layer fabric with paperside to lower surface weft ratios of greater than 1, wherein all paperside weft yarns interlace with the warp yarns in an identical manner and wherein said paperside weft yarns possess an average lateral crimp ratio of, or greater than, 1.62 and wherein the extremities of the lateral crimp of adjacent paperside weft yarns lie within a distance equivalent to one quarter of the nominal diameter of the paperside weft yarn giving a fabric characterised by an air permeability of less than 275 c.f.m. at ½ inch water pressure.

10. A multi-layer fabric with paperside to lower surface weft ratios of greater than 1, wherein all paperside weft yarns interlace with the warp yarns in an identical manner and wherein all adjacent paperside weft yarns intermittently buttress at at least half of the available buttress points and possess an average lateral crimp ratio of, or greater than, 1.62 giving a fabric characterized by an air permeability of less than 275 c.f.m. at ½ inch water pressure.

* * * * *